US009752262B1

(12) United States Patent
Martelli et al.

(10) Patent No.: US 9,752,262 B1
(45) Date of Patent: Sep. 5, 2017

(54) QUICK QUILT ATTACHMENT APPARATUS AND METHOD

(71) Applicants: John D. Martelli, Pensacola, FL (US); Marsha Martelli, Pensacola, FL (US)

(72) Inventors: John D. Martelli, Pensacola, FL (US); Marsha Martelli, Pensacola, FL (US)

( * ) Notice: Subject to any disclaimer, the term of this patent is extended or adjusted under 35 U.S.C. 154(b) by 596 days.

(21) Appl. No.: 14/212,131

(22) Filed: Mar. 14, 2014

(51) Int. Cl.
*D05B 39/00* (2006.01)
*D05B 91/10* (2006.01)

(52) U.S. Cl.
CPC ..... *D05B 39/005* (2013.01); *D05B 91/10* (2013.01)

(58) Field of Classification Search
CPC ..... D05B 11/00; D05B 39/005; D05B 39/00; D05B 91/10; D05B 91/06
See application file for complete search history.

(56) References Cited

U.S. PATENT DOCUMENTS 714,348 A * 11/1902 Youngblood ..... F16M 13/02 24/343
1,237,974 A * 8/1917 Thomas ..... D05C 1/02 112/119
1,299,873 A * 4/1919 Trueb ..... D06C 3/00 38/102.4
2,177,905 A * 10/1939 McKeehan ..... B43L 5/022 206/371
2,219,392 A * 10/1940 Jorgensen ..... A41F 11/02 211/89.01
2,236,421 A * 3/1941 Boettcher ..... B68G 7/08 112/118
2,704,415 A * 3/1955 Shiffman ..... D06C 3/00 38/102.8
3,044,426 A * 7/1962 Schwarzberger ..... D05B 11/00 112/117
3,577,583 A * 5/1971 Amann ..... B42F 1/02 16/87.2
6,836,899 B1 * 1/2005 Glasmire ..... A45F 5/04 2/323
7,302,898 B1 * 12/2007 Martelli ..... D05B 35/06 112/119
7,506,596 B2 * 3/2009 Bowlus ..... D05B 39/00 112/103
D611,678 S * 3/2010 Bailey ..... D2/624
7,966,957 B2 * 6/2011 Mack ..... D05C 9/04 112/103
9,145,630 B2 * 9/2015 McCoy ..... D05B 11/00

* cited by examiner

*Primary Examiner* — Danny Worrell
(74) *Attorney, Agent, or Firm* — J. Nevin Shaffer, Jr.

(57) ABSTRACT

A quick quilt attachment apparatus and method consists of a leader with a frame end and a quilt end. A first quick connector is provided at both the frame end and the quilt end of the leader. A trap flap is provided where the trap flap has a first end connected with the leader and a second end where the second end includes a second quick connector conformed to connect the second end of the trap flap to the first quick connector at the quilt end of the leader.

18 Claims, 2 Drawing Sheets

QUICK QUILT ATTACHMENT APPARATUS AND METHOD

CROSS REFERENCE TO RELATED APPLICATION

This application claims the benefit of previously filed U.S. provisional patent application No. 61/852,420 filed Mar. 15, 2013 for a "Quick Quilt Attachment Apparatus and Method". The Applicants hereby claim the benefit of this provisional application under 35 U.S.C. §119. The entire content of this provisional application is incorporated herein by this reference.

FIELD OF THE INVENTION

This invention relates to a quick quilt attachment apparatus and method. In particular, in accordance with one embodiment, the invention relates to a quick quilt attachment apparatus consisting of a leader with a frame end and a quilt end. A first quick connector is provided at both the frame end and the quilt end of the leader. A trap flap is provided where the trap flap has a first end connected with the leader and a second end where the second end includes a second quick connector conformed to connect the second end of the trap flap to the first quick connector at the quilt end of the leader.

BACKGROUND OF THE INVENTION

A problem exists with regard to quilting and in particular to the need in quilting to attach quilt material to a quilt frame. Currently, a leader is laid on the ground and quilting material is aligned on the leader and then held in place with straight pins. It is extremely important that the material is connected perfectly evenly with the leader because after the material is attached, the leader is connected with a quilt frame. Once connected with the quilt frame the leader with the material attached is rolled onto the frame while the quilting process begins. If the material is unevenly attached to the leader, the resulting quilt will include bags and sags and other unacceptable defects. The process typically requires more than one quilter to get on their hands and knees and spend an hour or more carefully pinning the material to the leader. Since the material is quite large and cumbersome to handle, it is not uncommon that misalignment occurs sometime during the process. When this happens it must be undone and re-pinned. Quilting loses quite a few enthusiasts because of this tedious and time consuming part of the process.

Thus, there is a need in the art for a quick and easy apparatus and method for attaching, quilting material to a quilting frame. There is a further need for a quilt attachment device that accurately and evenly connects quilt material to a leader and which, if misaligned, is easy to correct. It therefore is an object of this invention to provide a quick quilt attachment device that enables a single user to quickly and easily and accurately attach quilting material to a quilt frame. Further there is a need in the art for a quilt attachment device that is easy to connect with, and disconnect from, the frame of a quilting system either before or after the quilting material is evenly connected with the quilt attachment device.

SUMMARY OF THE INVENTION

Accordingly, the quick quilt attachment apparatus and method of the present invention, according to one embodiment, includes a leader with a frame end and a quilt end. A first quick connector is provided at both the frame end and the quilt end of the leader. A trap flap is provided where the trap flap has a first end connected with the leader and a second end where the second end includes a second quick connector conformed to connect the second end of the trap flap to the first quick connector at the quilt end of the leader.

All terms used herein are given their customary and normal meaning and as is known in the quilting art. Thus, "leader" describes a structure that connects two things together, like a leader on a fishing line connects with the line on one end and the hook on the other end of the leader. "Quilting system" is used herein to describe a device for making quilts in which quilting material is sewn/stitched together to make a quilt. Quilting systems include long frames upon which the quilting material is collected as it is stitched. These "frames" are long poles extending horizontally from one side of a quilting system to the other and are suspended between the sides. The frames are as long as or longer than the width of the quilting material being stitched so as to be able to receive the quilting material, all as is known by those in the art and not disclosed more fully hereafter. Nonetheless, it should be understood that the leader of the present invention is approximately as wide or wider than the quilting material it is used with and, further, therefor the leader is also approximately as wide as the frame/pole of the quilting device with which it is to be used.

Also, the term "trap flap" describes a device which is secured, in this case, on one end to the leader while the other end is not. This creates a "flap" oriented along the secured end and when lifted up, the flap creates a space, the interior inner edge of which is aligned with the secured end of the flap. The point is that by securing the one end evenly, meaning in a straight line for example, an interior space with a straight line is created into which, as will be described more fully hereafter, the leading edge of quilting material is placed. By this means, so long as the material is pressed against and aligned with the interior edge of the trap flap, the quilt material will be exactly aligned with the secured end of the trap flap.

According to a further aspect of the invention, the first quick connector is a magnet device and the second quick connector is a magnet attracting device. As used herein, the term "magnet device" describes a magnet or any device that acts like a magnet as is now known or hereafter developed. Further, the term "magnet attracting device" describes any device to which a magnet is attracted such as metal, such as angle iron and such as another magnet, for example only and not by way of limitation. By way of another example, well known hook and loop material, such as Velcro brand material, is included within the scope the invention as fulfilling the quick connection requirement of the invention in the form of a "magnet device" and a "magnet attracting device" even though not magnets or metal.

In other aspects, the second quick connector is a metal device and the second quick connector is angle iron. The term "angle iron" describes a piece of metal formed at an approximate right angle, typically. It creates two "faces" of metal, one face for connecting with a quick connector and one face for connection with a frame, for example only and not by way of limitation.

In one aspect, a quilting system with a frame is provided and the frame end of the leader is connected with the frame. In a further aspect, a third quick connector on the frame is provided and the first quick connector at the frame end of the leader removably connects with the third quick connector on the frame.

In other aspects, the second quick connector is a magnet and the third quick connector is a magnet attracting device or the third quick connector is a metal device and, in one aspect, the metal device is angle iron.

It should be understood that the requirement is for quick connectors that are easy to connect together, such as hook and loop material, or, preferably that are actually attracted to each other as are magnets and magnet attracting devices such as metal. When selected from a group, all that is required is that the selection result in one of each form, that is, one magnet device and one magnet attracting device.

According to another embodiment, in a quilting system including a frame, a quick quilt attachment apparatus consists of a leader with a frame end and a quilt end where the frame end of the leader is removably connectable with the frame. A first quick connector is provided at the frame end and also at the quilt end where the first quick connector is selected from a group consisting of: a magnet device and a magnet attracting device. A trap flap is provided where the trap flap has a first end connected with the leader and a second end where the second end includes a second quick connector conformed to connect the second end of the trap flap to the first quick connector at the quilt end of the leader and where the second connector is selected from a group consisting of: a magnet device and a magnet attracting device.

In other aspects, the magnet attracting device is a metal device; the magnet attracting device is angle iron; and/or the magnet attracting device is a maunet device.

In another aspect, the frame end of the leader is connected with the frame. In a further aspect, the invention further includes a third quick connector on the frame and the first quick connector at the frame end of the leader connects with the third quick connector on the frame.

In one aspect, the third quick connector is selected from a group consisting of: a magnet device and a magnet attracting device.

According to another embodiment, in a quilting system with a frame, a quick quilt attachment method consists of the steps of:

a. providing a leader with a frame end and a quilt end; a first quick connector at the frame end and the quilt end; and a trap flap where the trap flap has a first end connected with the leader and a second end where the second end includes a second quick connector conformed to connect the second end of the trap flap to the first quick connector at the quilt end of the leader; and b. connecting the frame end of the leader with the frame.

In one aspect, the method further includes placing quilt material over the quilt end of the leader and under the second end of the trap flap and connecting the second quick connector of the trap flap with the first quick connector of the leader such that the quilt is trapped in between.

In one aspect, the first quick connector and the second quick connector are selected from a group consisting of: a magnet device and a magnet attracting device.

In another aspect, the magnet attracting device is selected from a group consisting of: a magnet device and angle iron.

DESCRIPTION OF THE DRAWINGS

Other objects, features and advantages of the present invention will become more fully apparent from the following detailed description of the preferred embodiment, the claims and the accompanying drawings in which:

DETAILED DESCRIPTION OF THE INVENTION

Figure 1:
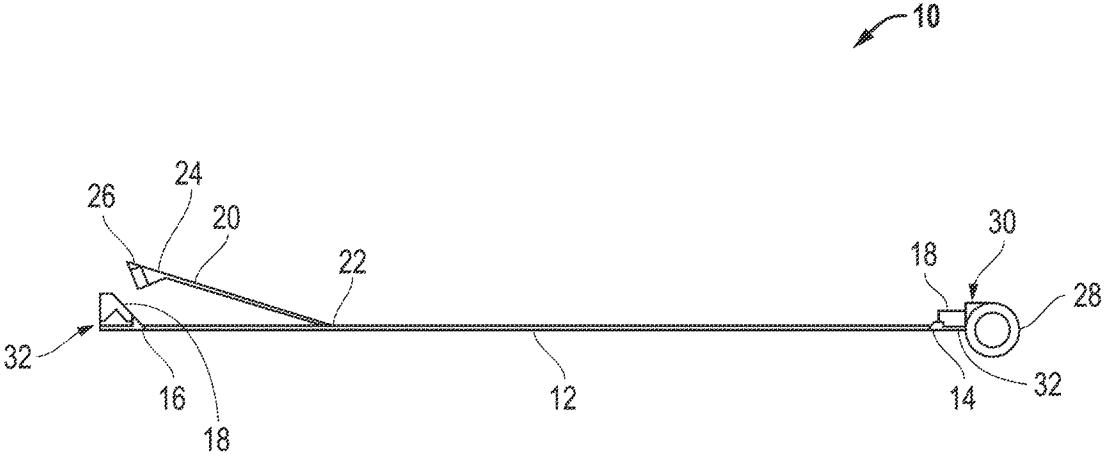
FIG. 1 is a side view of the quick quilting attachment of the present invention.
Figure 2:
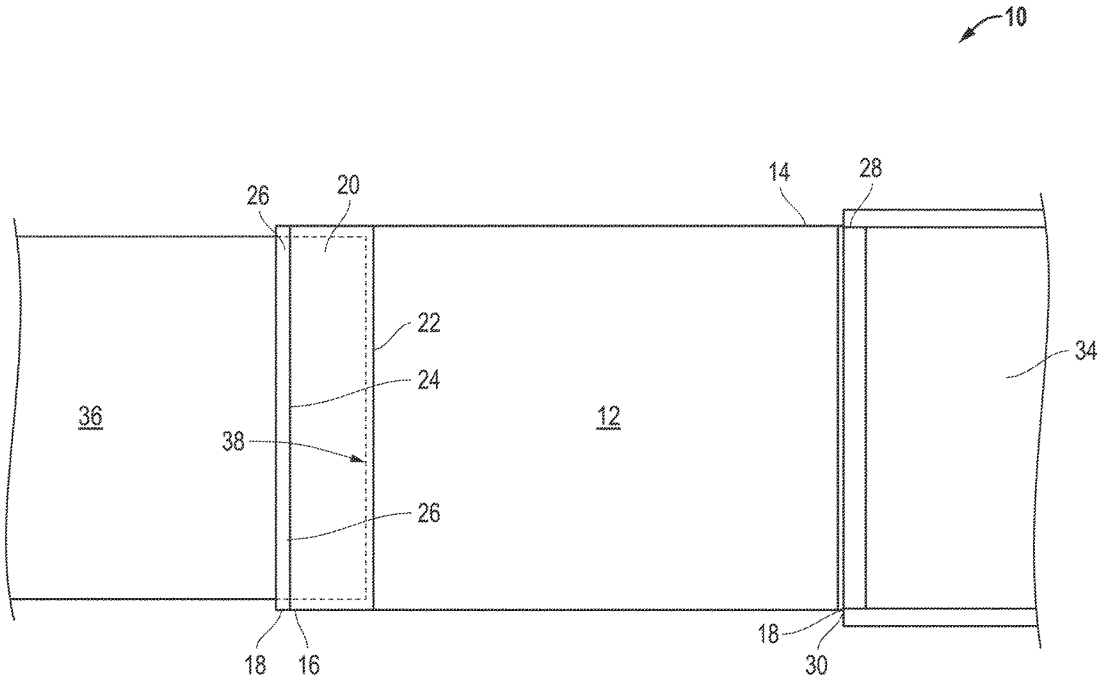
FIG. 2 is a top view of the invention of FIG. 1 showing quilt material attached to the invention.

The preferred embodiment of the present invention is illustrated by way of example in FIGS. 1 and 2. With specific reference to FIG. 1, quick quilt attachment apparatus 10 includes a leader 12. Leader 12 has a frame end 14 and a quilt end 16. A first quick connector 18 is attached to both frame end 14 and to quilt end 16. A trap flap 20 is provided with a first end 22 and a second end 24. The first end 22 of the trap flap 20 is connected to the leader 12 between the frame end 14 and the quilt end 16 of the leader 12. Preferably, and as illustrated in FIG. 1, first end 22 is connected with leader 12 near quilt end 16. The second end 24 of the trap flap 20 includes a second quick connector 26 conformed to removably connect with the first quick connector 18 at the quilt end 16 of the leader 12. In one case, for example only as described above, the first quick connector 18 at the quilt end 16, in one aspect, includes material, such as a magnet device, to which second quick connector 26 is attracted, by being formed of material such as metal, for example only and not by way of limitation. It may also be that first quick connector 18 in quilt end 16 includes a magnet oriented to attract and be attracted to the second quick connector 26 in the form of another magnet. Likewise first quick connector 18 at frame end 14 of leader 12 is conformed to connect with a quilt frame 28. This attraction may be to the quilt frame 28 directly since the quilt frame 28 is typically metal. On the other hand, a third quick connector 30 may be provided. The third quick connector 30 is attached to the quilt frame 28 in any manner known, such as by welding, gluing, taping and the like. Third quick connector 30, as with first quick connector 18 and second quick connector 26, consists of either a magnet device or a magnet attracting device. Third quick connector 30, for example only, may be created by attaching a piece of angle iron 32 to the quilt frame 28. In fact, Applicant has observed that a third quick connector 30 in the form of an angle iron 32 with an extended face, shown at quilt end 16 in the FIG. 1 for illustrative purposes, helps in holding quilt end 16 of the leader 12 in place on the quilt frame 28.

Referring now to FIG. 2, a top view of the quick quilt attachment apparatus 10 is shown with a quilt system 34 supporting quilt frame 28. Also shown is quilt material 36. As illustrated, the leading edge 38 of quilt material 36 is shown aligned with the first end 22 of trap flap 20 on the inside of the trap flap 20. That is, quilt material 36 is placed over the top of quilt end 16 of leader 12 and under trap flap 20. The leading edge 38, again, is aligned with the secured first end 22 on the inside or underneath trap flap 20. Thus, when the second quick connector 26 on trap flap 20 is connected with the first quick connector 18 at the quilt end 16 of leader 12, quilt material 36 is "trapped" between them and held securely in place. Importantly the ever critical requirement that the quilt material 36 be evenly attached to the leader 12 is ensured by the alignment of leading edge 38 with the secured first end 22 of trap flap 20. Any readjustment that is required of quilt material 36 is a simple matter of lifting trap flap 20, adjusting the quilt material 36 and replacing the second end 24 of trap flap 20 such that first quick connector 18 and second quick connector 26 reconnect.

Again, all terms used herein are given their common meaning and the meaning of those knowledgeable about quilting.

In use, a person places the leading edge 38 of a length of quilting material 36 up to and all along the length of the connection of trap flap 20 first end 22 on the inside of and underneath the trap flap 20 and on top of the leader 12. Quilting material 36 will cover quilt end 16 and be perfectly and accurately aligned with leader 12. Thereafter, all a user has to do is lay down second end 24 of trap flap 20 and second quick connector 26 connects seamlessly to first quick connector 18 at the quilt end 16 of leader 12. No pins are required. A job that can literally take hours is done in minutes. If the quilt material 36 is misaligned, all that needs to be done is to separate first quick connector 18 from second quick connector 26 and reposition the quilt material 36 under the trap flap 20 and then lower second quick connector 26 as described before.

Similarly, connection of frame end 14 to quilt frame 28, which also, prior to the present invention, is a difficult process particularly when the prior art leader is festooned with pins and subject to snagging and movement, simply requires the user to align first quick connector 18 with the quilt frame 28, including preferably third quick connector 30 attached to it, or the like. Thus this entire heretofore difficult process takes minutes and is easy to adjust and maneuver.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as disclosed and illustrated herein and as set forth in the following claims.

What is claimed is:

1. In a quilting system including a frame, a quick quilt attachment apparatus comprising:

a. a leader with a length and a width and with a frame end and a quilt end wherein said frame end of said leader is removably connectable with said frame;

b. a first quick connector at both said frame end and said quilt end of said leader; and c. a trap flap wherein said trap flap has a first end and a second end, wherein said first end is connected with said leader in between said frame end of said leader and said quilt end of said leader and wherein said first end connection creates a single straight alignment space along the first end connection across the width of said leader in between said frame end of said leader and said quilt end of said leader such that an object placed in between said trap flap and said leader and against said first end of said trap flap is aligned with said single straight alignment space between said trap flap and said leader and wherein said, second end of said trap flap includes a second quick connector conformed to connect said second end of said trap flap to said first quick connector at said quilt end of said leader by connecting said second quick connector with said first quick connector at said quilt end.

2. The apparatus of claim 1 wherein said frame end of said leader is connected with said frame.

3. The apparatus of claim 2 further including a third quick connector on said frame and wherein said first quick connector at said frame end of said leader connects with said third quick connector on said frame.

4. The apparatus of claim 3 wherein said third quick connector is selected from a group consisting of: a magnet device and a magnet attracting device.

5. In a quilting system with a frame, a quick quilt attachment method comprising:

a. providing a leader with a length and a width and with a frame end and a quilt end; a first quick connector at both said frame end and said quilt end; and a trap flap wherein said trap flap has a first end and a second end, wherein said first end is connected with said leader in between said frame end of said leader and said quilt end of said leader and wherein said first end connection creates a single straight alignment space along the first end connection across the width of said leader in between said frame end of said leader and said quilt end of said leader such that an object placed in between said trap flap and said leader and against said first end of said trap flap is aligned with said single straight alignment space in between said trap flap and said leader and wherein said second end of said trap flap includes a second quick connector conformed to connect said second end of said trap flap to said first quick connector at said quilt end of said leader by connecting said second quick connector with said first quick connector at said quilt end; and b. connecting said frame end of said leader with said frame.

6. The method of claim 5 wherein said object is quilt material and further comprising placing said quilt material over said quilt end of said leader and under said second end of said trap flap and aligning said quilt material with said single straight alignment space and then connecting the second quick connector of said trap flap with said first quick connector of said leader such that said quilt material is trapped in between.

7. The method of claim 5 wherein said first quick connector and said second quick connector are selected from a group consisting of: a magnet device and a magnet attracting device.

8. The method of claim 7 wherein said magnet, attracting device is selected from a group consisting of: a magnet device and angle iron.

9. The apparatus of claim 1 wherein said first quick connector is selected from a group consisting of: a magnet device and a magnet attracting device.

10. The apparatus of claim 1 wherein said object is quilt material.

11. The apparatus of claim 1 wherein said trap flap covers the length and width of said leader from said first end connection of said flap trap with said leader up to said quilt end of said leader.

12. The method of claim 5 further including a third quick connector on said frame and wherein said first quick connector at said frame end of said leader connects with said third quick connector on said frame.

13. The method of claim 12 wherein said third quick connector is selected from a group consisting of: a magnet, device and a magnet attracting device.

14. The method of claim 13 wherein said magnet attracting device is selected from a group consisting of: a magnet device and angle iron.

15. The method of claim 5 wherein said trap flap covers the length and width of said leader from said first end connection of said flap trap with said leader up to said quilt end of said leader.

16. The apparatus of claim 9 wherein said magnet attracting device is a metal device.

17. The apparatus of claim 9 wherein said magnet attracting device is angle iron.

18. The apparatus of claim 9 wherein said magnet attracting device is a magnet device.

* * * * *